United States Patent [19]

Augoyard et al.

[11] Patent Number: 4,590,763

[45] Date of Patent: May 27, 1986

[54] METHOD OF SUPPLYING A NORMALLY CONTINUOUS OPERATING HYDRAULIC ACTUATOR WITH HYDRAULIC FLUID, CONTINUOUSLY AND BY CONTROLLED PULSE, AND A DEVICE FOR IMPLEMENTING SAID METHOD

[75] Inventors: Jean-Pierre Augoyard, Domont; Philippe Guggemos, Courbevoie, both of France

[73] Assignee: GTM Entrepose, Nanterre, France

[21] Appl. No.: 666,824

[22] Filed: Oct. 31, 1984

[30] Foreign Application Priority Data

Nov. 2, 1983 [FR] France ..... 83 17382

[51] Int. Cl.[4] ..... F15B 1/02

[52] U.S. Cl. ..... 60/327; 60/416

[58] Field of Search ..... 60/327, 416

[56] References Cited

U.S. PATENT DOCUMENTS 3,048,016 8/1962 Buechner ..... 60/416

*Primary Examiner*—Gerald A. Michalsky

*Attorney, Agent, or Firm*—Amster, Rothstein & Ebenstein

[57] ABSTRACT

A method of supplying a normally continuous operating hydraulic actuator with hydraulic fluid, continuously and by controlled pulse, comprising the steps of supplying a chamber of an actuator and, simultaneously, storing an hydraulic energy in an accumulator from a pressurized fluid source, as long as the pressure in the chamber remains less than a chosen value, isolating the accumulator from the source when the pressure in the chamber reaches a chosen value, connecting the chamber to a reservoir, then isolating the chamber from the reservoir, then causing the accumulator to communicate with the chamber, isolating the chamber from the accumulator and re-establishing the communication between the source, on the one hand, and the chamber and the accumulator, on the other, and maintaining them in this state as long as the pressure in the chamber does not again reach said chosen value.

11 Claims, 8 Drawing Figures

METHOD OF SUPPLYING A NORMALLY CONTINUOUS OPERATING HYDRAULIC ACTUATOR WITH HYDRAULIC FLUID, CONTINUOUSLY AND BY CONTROLLED PULSE, AND A DEVICE FOR IMPLEMENTING SAID METHOD

BACKGROUND OF THE INVENTION

Field of the Invention

The present invention relates to a method of supplying a normally continuous operating hydraulic actuator with hydraulic fluid, continuously and by controlled pulse, and it also relates to a device for implementing said method.

Continuously operating hydraulic actuators and the system for supplying the with hydraulic fluid are well known. They are usually used for moving a load or a tool in a continuous movement over a distance which may be relatively large. Whether they work by pushing or pulling, a pressure chamber of the actuator is supplied with pressurized hyraulic fluid for moving the piston of the actuator over a part of the whole of its stroke in a continuous movement at a speed which depends on the supply pressure and on the resisting forces met by the piston rod of the actuator.

The piston rod is returned to its starting position either by means of a spring (single acting actuator) or by supplying the other chamber of the hydraulic actuator with pressurized fluid (double acting actuator).

Systems with energy accumulation are also known for supplying hydraulic fluid for hydraulic reciprocating apparatus, for example power-hammers, hydraulic picks, hydraulic rock breakers or the like, in which the piston of the actuator acts on a tool like a reciprocating hammer. In this case, the supply system always emits for each stroke of the piston, a single constant energy hydraulic pulse. Each hydraulic pulse moves the piston over the whole of its stroke. Because of their repetitive aspect, these known systems may be likened to vibrators. They can only be used on short stroke actuators (of the order of 10 cm). Since the hydraulic pulse is systematic, the effective resistance met with during movement of the piston of the actuator is in fact not taken into account and no attempt is mode to modulate the amount and value of an added hydraulic energy used as a function of the parameters of use.

In numerous technical fields, it may happen that the piston rod of a normally continuous working hydraulic actuator meets an increase in resistance in a given position of its stroke or, occasionally, in any position during its stroke. The pump and the hydraulic circuits of the supply device may of course be dimensioned so that said device is capable of supplying the actuator with sufficient hydraulic pressure to overcome such an increase in resistance. However, that results in overdimensioning the supply device with respect to the current requirements. In any case, if the increase in resistance is such that the pressure in the actuator becomes greater than the maximum pressure which the pump may provide, the actuator can no longer work.

It would therefore be advantageous to have a supply device such that a normally continuous operating actuator is capable of producing a momentary dynamic effort, in any position of its stroke, to overcome an increase in resistance during movement of its piston rod, without it being necessary to this end to overdimension the supply device.

The object of the present invention is to solve this problem.

SUMMARY OF THE INVENTION

Accordingly, the invention provides a method of supplying a normally continuous operating hydraulic actuator with hydraulic fluid, continuously and by controlled pulse, comprising the steps of supplying a pressure chamber of the hydraulic actuator with hydraulic fluid and, simultaneously, storing hydraulic energy in an accumulator from a pressurized fluid source as long as the pressure in the pressure chamber of the actuator and in the accumulator remains less than a chosen value, so that the actuator works normally in continuous operation, isolating the accumulator from the pressurized fluid source when the pressure in the pressure chamber of the actuator and in the accumulator reaches said chosen value, connecting the pressure chamber of the actuator and the pressurized fluid source to a hydraulic fluid reservoir for causing the pressure in said pressure chamber to drop, then isolating the pressure chamber of the actuator from the reservoir, then causing the accumulator to communicate with the pressure chamber of the actuator so as to feed therein a hydraulic fluid pulse and, then, isolating the pressure chamber of the actuator from the accumulator and reestablishing the communication between the pressurized fluid source, on the one hand, and the pressure chamber and the accumulator, on the other hand, and maintaining them in this condition as long as the pressure in the pressure chamber and in the accumulator does not again reach said chosen value.

The invention also provides a supply device for implementing the above method, comprising a pump, a fluid reservoir, a first pipe having a first end and a second end connectible to a pressure chamber of a hydraulic actuator, and a main distributor valve connected to the pump, to the reservoir and to the first end of the first pipe for causing said first pipe to communicate selectively with the pump or with the reservoir. The supply device is characterized in that it further comprises a first controlled valve which is connected to the first pipe and to the reservoir and which has a rest position, in which the first pipe is isolated from the reservoir, and a working position, in which a communication is established between the first pipe and the reservoir, a second controlled valve which is inserted in the first pipe between the second end thereof and the first controlled valve and which has a rest position, in which fluid is allowed to flow in the first pipe, and a working position, in which said fluid flow is cut off, a second pipe having a first end and a second end which are connected to the first pipe respectively between the main distributor and the second controlled valve and between the second controlled valve and the second end of the first pipe, a check-valve, a first pressure accumulator and a third controlled valve, said check-valve, said first accumulator and said third controlled valve being inserted in series in the second pipe from the first end to the second thereof, said third controlled valve having a rest position, in which fluid flow in the second pipe is cut off, and a working position, in which fluid is allowed to flow from the first accumulator to the second end of the second and first pipes, a sequential control unit connected to the first, second and third controlled valves for successively actuating, in order, the first, the second and the third controlled valves into their working position and for bringing them back to their rest position, and a control device connected to the sequential control unit for initiating an operating sequence of the controlled valves.

BRIEF DESCRIPTION OF THE DRAWINGS

Other features and advantages of the present invention will appear in the following description of an embodiment of the supply device of the present invention, with reference to the accompanying drawings in which.

DESCRIPTION OF THE PREFERRED EMBODIMENT

Figure 1:
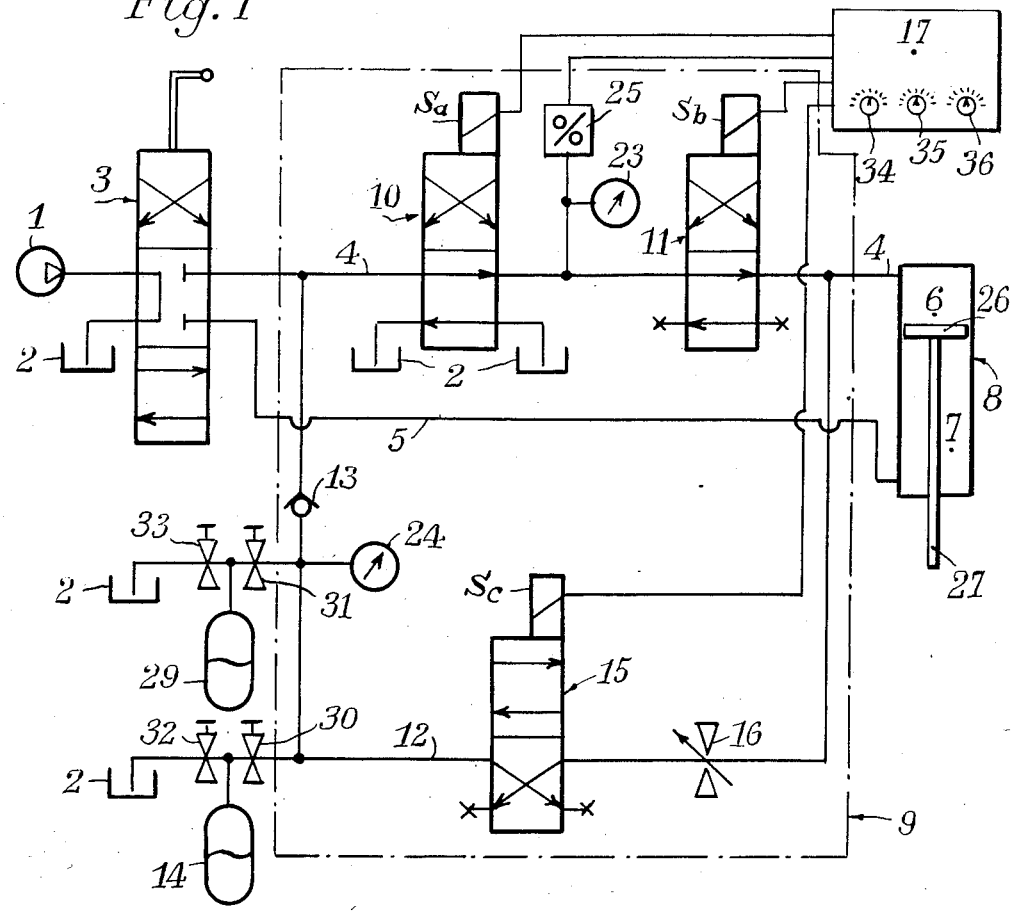
FIG. 1 shows schematically the hydraulic circuits of the supply device of the present invention.

The supply device shown in FIG. 1 comprises a pump 1, an hydraulic fluid reservoir 2, a main distributor 3 and two pipes 4 and 5 connected respectively to the two pressure chambers 6 and 7 of the cylinder of a double acting actuator 8 (a single one of the two pipes 4 and 5 would be provided in the case of a single acting actuator). In FIG. 1, the main distributor 3 is shown in a neutral position, in which the fluid drawn up by the pump 1 from reservoir 2 is delivered back to the reservoir. When the main distributor 3 is placed in either of its two working positions, the fluid drawn in by pump 1 is sent through pipe 4 to chamber 6 or through pipe 5 to chamber 7, depending on the working position of the main distributor, that one of the two chambers 6 and 7 which is not fed with pressurized fluid being connected through pipe 4 or 5 to the reservoir.

In the following description, it will be assumed that the hydraulic actuator 8 is intended for pushing operation. The supply device of the present invention further comprises a hydraulic block 9 which, in the above contemplated case, is inserted in pipe 4 between the main distributor 3 and the chamber 6 of the actuator 8. The hydraulic block 9 comprises a first controlled valve 10 which is inserted in pipe 4 and which, in its rest position shown in FIG. 1, allows hydraulic fluid to flow through pipe 4 and, in its working position, establishes a communication between pipe 4 and reservoir 2. The hydraulic block 9 comprises a second controlled valve 11 which is also inserted in pipe 4 between the controlled valve 10 and chamber 6 of the actuator 8 and which, in its rest position shown in FIG. 1, allows fluid to flow into pipe 4 and, in its working position, cuts off said flow.

The hydraulic block 9, further comprises a pipe 12, one end of which is connected to pipe 4 between the main distributor 3 and the second controlled valve 11, for example between the main distributor 3 and the first controlled valve 10 as shown in FIG. 1, and the other end of which is connected to pipe 4 between the second controlled valve 11 and the chamber 6 of actuator 8. In pipe 12 are inserted in series, from the first end to the second end thereof, a check-valve 13, a pressure accumulator 14 and a third controlled valve 15. The check-valve 13 is connected so as to allow the hydraulic fluid to flow only from the main distributor 3 to the accumulator 14. In its rest position shown in FIG. 1, the controlled valve 15 cuts off the flow of fluid in pipe 12, whereas, in its working position, it allows fluid to flow from the accumulator 14 to the chamber 6 of actuator 8. As shown in FIG. 1, an adjustable nozzle 16 may be inserted in pipe 12 downstream of the controlled valve 15 for adjusting the flow of hydraulic fluid to the chamber 6 of actuator 8 when the controlled valve 15 is in its working position.

Figure 4:
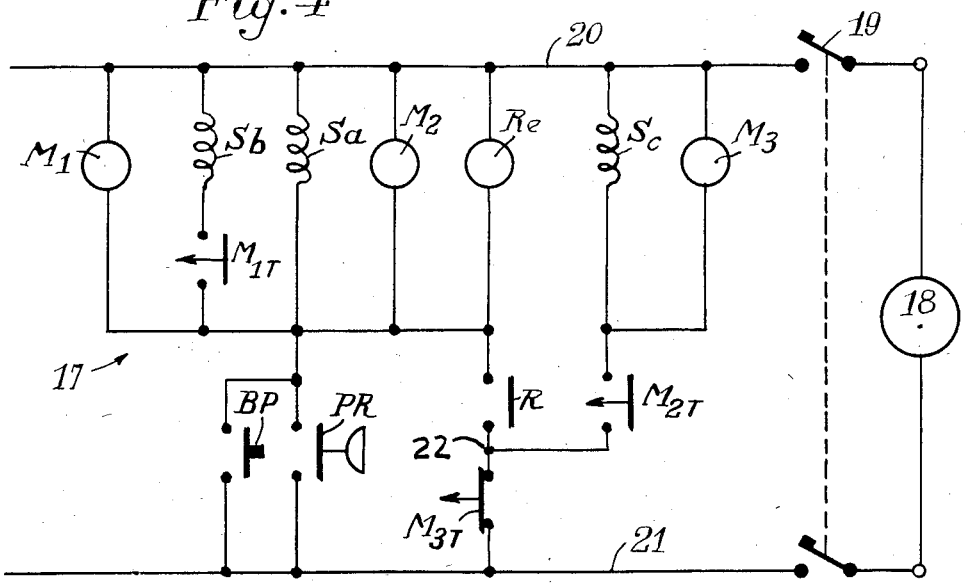
FIG. 4 shows schematically a sequential control unit associated with the supply device of FIG. 1.

The controlled valves 10, 11 and 15 can be actuated by a sequential control unit 17 which will be now described with reference to FIG. 4. In the following description, it will be assumed that the three controlled valves 10, 11 and 15 are electro-valves actuatable by energizing coils or solenoids Sa, Sb and Sc respectively. In FIG. 4, number 18 designates a power supply source, for example a 12 volt or 24 volt battery, and number 19 designates a switch which, when it is "on", connects two supply conductors 20 and 21 respectively to the terminals of the power supply source 18. The sequential control unit 17 comprises a first relay Re having a normally open movable contact R, second and third relays $M_1$ and $M_2$ both having a movable contact, respectively $M_{1T}$ and $M_{2T}$, normally open and time delayed for closing, and a fourth relay $M_3$ having a movable contact $M_{3T}$ normally closed and time delayed for opening. The duration of the time delay of the third relay $M_2$ is slightly greater than that of the second relay $M_1$ as will be seen further on. A first terminal of the energizing coils of relays Re $M_1$, $M_2$, $M_3$ and of the solenoids Sa, Sb and Sc is connected to the supply conductor 20. The other terminal of the energizing coils of relays Re, $M_1$, $M_2$ and of the solenoids Sa and Sb, the latter through the normally open contact $M_{1T}$, is connected to the supply conductor 21, on the one hand, through either of two normally open movable contacts BP and PR connected in parallel, and, on the other hand, through the normally open contact R and the normally closed contact $M_{3T}$ connected in series. The other terminal of the energizing coil of relay $M_3$ and of solenoid Sc is connected to the junction point 22 between the normally open contact R and the normally closed contact $M_{3T}$ through the normally open contact $M_{2T}$.

Contact BP is a push button contact. It provides manual control for initiating an operating sequence of the electrovalves 10, 11 and 15, providing that the pressure in the chamber 6 of actuator 8 and in the accumulator 14 has reached a sufficient value, which may be controlled by means of either of the two pressure gauges 23 and 24 connected to pipes 4 and 12, respectively (FIG. 1). Contact PR is the movable contact of a presettable pressure controller 25, which provides automatic control of the initiation of an operating sequence of electrovalves 10, 11 and 15 whenever the pressure in chamber 6 of actuator 8 and in accumulator 14 reaches the triggering threshold of pressure controller 25. The triggering threshold of pressure controller 25 may for example be preset to the maximum pressure which pump 1 can supply or to a value slightly less than said maximum pressure. Pressure controller 25 is connected, from the hydraulic point of view, to pipe 4 between the main distributor 3 and electrovalve 11 (FIG. 1).

Of course, if it is desired to control the initiation of an operating sequence of electro-valves 10, 11, and 15 solely manually or solely automatically, either of the two contacts BP and PR may be omitted depending on the case.

Figure 5:
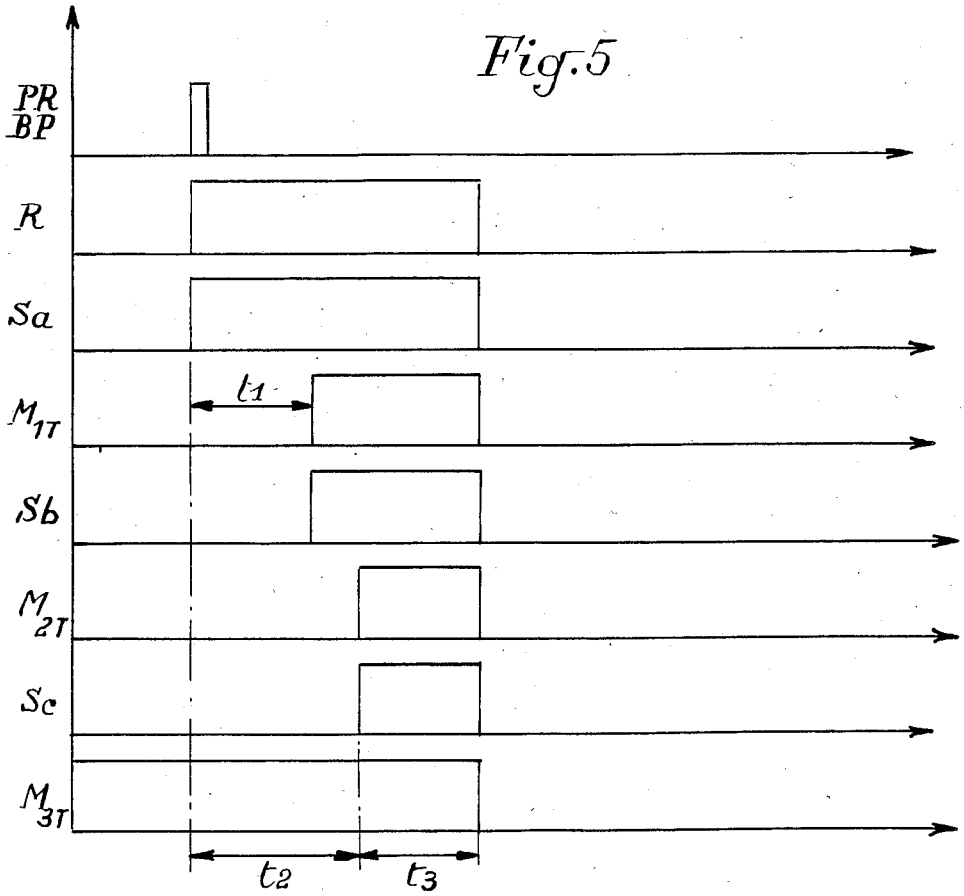
FIG. 5 is a diagram illustrating the operation of the sequential control unit of FIG. 4.

The operation of the supply device of the present invention will now be described with reference to FIGS. 1, 4 and 5. For greater clarity, it will be assumed that the triggering threshold of pressure controller 25 is adjusted to a pressure of 300 bars and that the accumulator 14 is a diaphragm accumulator, inflated with nitrogen to a pressure of 100 bars (of course, other types of pressure accumulators may be used, for example accumulators in which the active element, diaphragm or piston, is prestressed by means of a calibrated spring). Thus, when the electro-valves 10, 11 and 15 are in their rest position shown in FIG. 1 and when the main distributor 3 is in such a position that the chamber 6 of the actuator 8 is supplied with pressurized fluid through pipe 4 and through electro-valves 10 and 11, the piston 26 of actuator 8 and its piston rod 27 are moved outwardly in a continuous movement. If the piston rod 27 meets an appreciable resistance at any time during its stroke, the pressure of the fluid rises in chamber 6 of the actuator and in pipe 4. As soon as the pressure exceeds 100 bars, the accumulator 14 begins to be loaded through the check-valve 13 and to store energy by movement of its diaphragm. If, because of the increase in pressure, the actuator succeeds in overcoming the resistance which is opposed to it, the system then resumes its normal operation. On the other hand, if the actuator does not succeed in overcoming the resistance which is opposed to it, the pressure in chamber 6 and in pipe 4 still increases and the accumulator 14 continues to store energy until the pressure reaches the triggering threshold of pressure controller 35, for example 300 bars. The normally open contact PR closes, which is shown by a high state in the diagram of FIG. 5 (in FIG. 5 the closed state of the contacts and the energized state of the coils is shown by a high state, whereas the open state of the contacts and the de-energized state of the coils is shown by a low state). The closure of contact PR causes the energization of the coil of relay Re which closes its contacts R, and also energization of the coils of relays $M_1$ and $M_2$ and of coil Sa of electrovalve 10. However, at this time, the coil of relay $M_3$ and coils Sb and Sc of the electro-valves 11 and 15 are not yet energized because the contacts $M_{1T}$ and $M_{2T}$ of relays $M_1$ and $M_2$ only close after time delays $t_1$ and $t_2$, respectively.

Energization of coil Sa causes electro-valve 10 to switch to its working position. The result is that pipe 4 is now connected to reservoir 2. Consequently, the pressure in pipe 4 and in chamber 6 of the actuator 8 drops rapidly to zero, the check-valve 13 closes and contact PR of the pressure controller 25 resumes its open state. Opening of contact PR has no effect since, at this time, contact R is closed and maintains energization of the coils of relays Re, $M_1$ and $M_2$ and of the coil Sa.

After a time delay $t_1$ (FIG. 5), for example 0.5s, corresponding to the time delay of relay $M_1$, contact $M_{1T}$ closes, which causes energization of the coil Sb of electro-valve 11 which is then switched to its working position. The result is that the chamber 6 of actuator 8 is no longer connected to the reservoir.

After a time delay $t_2$ (FIG. 5) which corresponds to the time delay of relay $M_2$ and which is slightly greater than the time delay $t_1$, for example 0.7s, contact $M_{2T}$ closes, which causes the coil of relay $M_3$ and the coil Sc of electro-valve 15 to be energized. The latter is then switched to its working position, and, consequently, the accumulator 14 is connected to chamber 6 of actuator 8 and applies thereto a hydraulic fluid pulse. Preferably, the length of pipe 12 and of pipe 4 between the accumulator 14 and actuator 8 is the shortest possible so that the hydraulic fluid pulse is transmitted to chamber 6 in the shortest possible time. Since the hydraulic pulse is applied within a brief space of time to chamber 6 of actuator 8, piston 26 receives a hydraulic shock of high power which contributes to overcoming the resistance opposing the movement of the piston rod 27. It will be noted that, while pipe 4 and chamber 6 were connected to reservoir 2, the piston 26 of actuator 8 has moved slightly back because of the resistance opposing the movement of the piston rod 27. Thus, when the hydraulic pulse is applied to chamber 6, piston 26 is again moved outwardly and its kinetic energy is added to the energy of the hydraulic shock for overcoming the resistance opposing the movement of the piston rod 27. So as to take further advantage from the kinetic energy of piston 26 during the duration of the hydraulic shock, it is also possible to cause piston 26 to move further back while chamber 6 and pipe 4 are connected to the reservoir through the electro-valve 10 and before the hydraulic pulse is applied to chamber 6 through the electro-valve 15. This may be obtained for example by momentarily supplying the chamber 7 of actuator 8 with pressurized fluid by means of an additional electrovalve suitably disposed between pump 1 and pipe 5.

At the end of time delay $t_3$ (FIG. 5), for example 0.5s, corresponding to the time delay of relay $M_3$, contact $M_{3T}$ opens, which results in de-energizing the coils of all the relays Re, $M_1$, $M_2$ and $M_3$ and the coils Sa, Sb, Sc of the electro-valves 10, 11 and 15. Thus, the sequential control unit 17 is reset to its initial state.

If the resistance which opposed the movement of the piston rod 27 of actuator 8 has been overcome, the pressure in chamber 6 of the actuator drops again and the piston rod resumes its continuous movement until it again meets a higher resistance. On the other hand, if the resistance which opposed the movement of the piston rod 27 has not been overcome by the first hydraulic shock applied to piston 26, the pressure in chamber 6 of the actuator rises again rapidly and, simultaneously, the accumulator 14 again stores hydraulic energy, until the pressure reaches the triggering threshold of the pressure controller 25 (300 bars), thus causing a second operating sequence of electro-valves 10, 11 and 15 and, consequently, a second hydraulic shock on the piston 16 of the actuator. The operating sequence of electro-valves 10, 11 and 15 is thus repeated and a succession of hydraulic shocks are applied to piston 26 of the actuator as long as the resistance which opposes the movement of the piston rod 27 has not been overcome, after which the piston rod 27 resumes its continuous movement until it again meets a higher resistance.

In the foregoing, it has been assumed that each operating sequence of electro-valves 10, 11 and 15 is initiated automatically by the pressure controller 25. However, in the case where the push button BP is provided, by depressing one or more times the push button BP, an operator may manually initiate one or more operating sequences of the electro-valves when he realises that a higher resistance is opposed to the movement of the piston rod 27 or when he realises that the pressure read from either of the pressure gauges 23 and 24 has exceeded the nitrogen inflation pressure in accumulator 14 (100 bars in the example considered here).

Figure 6:
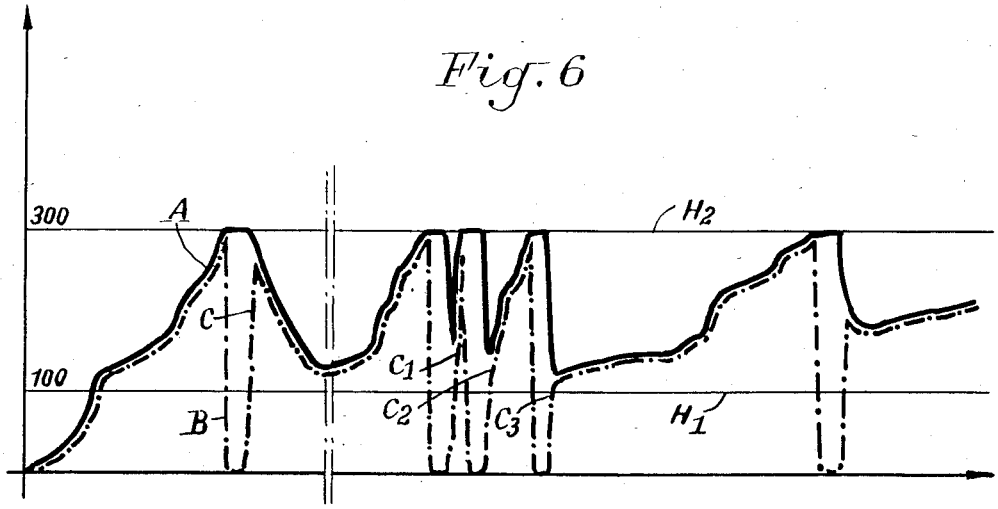
FIG. 6 is a time/pressure diagram, showing how the pressure in the actuator and the pressure in the accumulator of the supply device of FIG. 1 evolve during operation with the supply device of the present invention.

In the graph of FIG. 6, the continuous curve A shows the variation in time of the pressure of the hydraulic fluid in accumulator 14, whereas the broken curve B shows the variation in time of the pressure in chamber 6 of actuator 8 during a typical operating example. In the left hand part of the graph of FIG. 6 is shown the case where a single hydraulic shock C is sufficient for overcoming the resistance opposing the movement of the piston rod 27, whereas in the middle part of the same graph is shown the case where three successive hydraulic shocks $C_1$, $C_2$ and $C_3$ are required for overcoming the resistance opposing the movement of the piston rod 27. In the graph of FIG. 6, the lower horizontal line $H_1$ represents the inflation pressure of the nitrogen in accumulator 14, the upper horizontal line $H_2$ represents the maximum pressure which pump 1 can provide and also the triggering threshold of the pressure controller 25, and the zone between the two lines $H_1$ and $H_2$ represents the working range of accumulator 14. If it is desired to operate in a wider or narrower range than the one shown in FIG. 6, the inflation pressure of the nitrogen in the accumulator 14 may of course be adjusted. However, it is more rational to use one or more other accumulators, such as accumulator 29 shown in FIG. 1, the additional accumulator or accumulators having a diaphragm which is prestressed to a pressure different from that of the diaphragm of accumulator 14. In this case, cocks 30 and 31 are provided for selectively communicating accumulator 14 or accumulator 29 with pipe 12, whereas cocks 32 and 33 are provided for communicating the unused accumulator 14 or 29 with reservoir 2.

If desired, the time delays of relays $M_1$, $M_2$ and $M_3$ may be adjusted in a known manner for example by means of adjusting knobs 34, 35 and 36 respectively, accessible on one face of the case of the sequential control unit 17 (FIG. 1).

Figure 2:
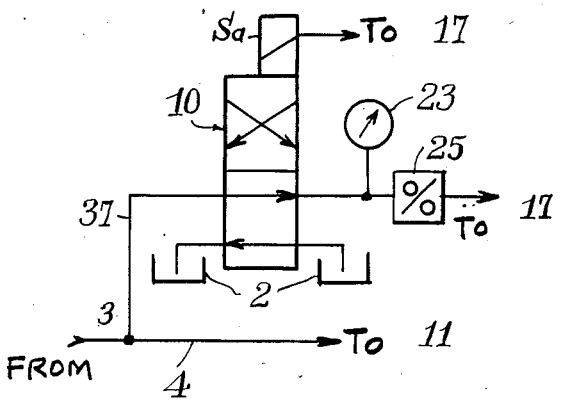
FIG. 2 shows another way of connecting one of the controlled valves of the supply device of FIG. 1.

In the embodiment of the hydraulic block 9 shown in FIG. 1, it has been assumed that the controlled valve 10 was inserted in pipe 4. However, the controlled valve 10 may be inserted in a pipe 37 connected to pipe 4 as shown in FIG. 2. In this case, the operation would be exactly the same as that described above.

Figure 3:
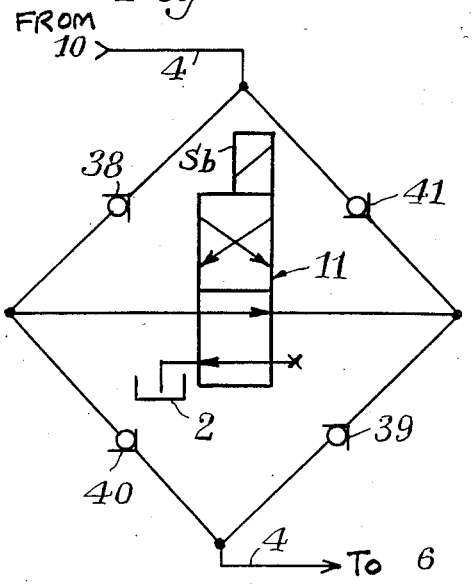
FIG. 3 shows another way of connecting another controlled valve of the supply device of FIG. 1.

Furthermore, in the hydraulic block 9 shown in FIG. 1, when the controlled valve 11 is in its rest position, the hydraulic fluid flows from left to right through this valve when chamber 6 of the actuator is normally supplied with pressurized fluid (controlled valve 10 in its rest position), whereas the hydraulic fluid flows from right to left through the controlled valve 11 when chamber chamber 6 is connected to reservoir 2 through the controlled valve 10 in its working position. With some models of controlled valves, it is desirable for the hydraulic fluid to flow always in the same direction through the controlled valve. In this cas, the controlled valve 11 may be connected, from the hydraulic point of view, as shown in FIG. 3. More precisely, four check-valves 38, 39 40 and 41 are connected as in a full-wave rectifier bridge which is inserted in pipe 4, the latter being connected to the ends of one diagonal of the bridge, the controlled valve 11 being connected in the other diagonal of the bridge. Thus, when chamber 6 of actuator 8 is supplied with pressurized fluids, the fluid flows successively through the upper part of pipe 4, the check-valve 38, the controlled valve 11, the check-valve 39 and the lower part of pipe 4. On the other hand, when the chamber 6 of actuator 8 is connected to reservoir 2, the hydraulic fluid flows successively through the lower part of pipe 4, the check-valve 40, the controlled valve 11, the check-valve 41 and the upper part of pipe 4. In both cases, the hydraulic fluid thus passes through the controlled valve 11 in the same direction.

The present invention finds an application in numerous technical fields. By way of examples, there may be mentioned the working of metals, (presses for extrusion, drawing, stamping, pressing) and the working of soils and rocks (hydraulic shovels operating by pulling or loading, civil work or agricultural tractors for ripping, etc) and, generally, in all cases where a normally continuous working hydraulic actuator must be able to supply a momentary dynamic force, at any point in its stroke, for overcoming an increase in resistance during movement of its piston rod.

Figure 7:
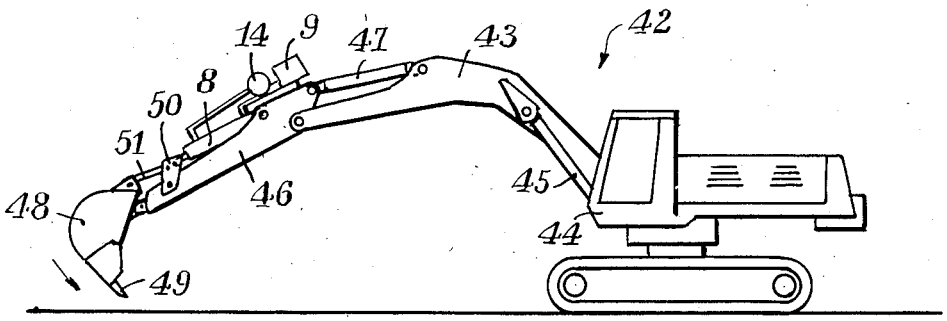
FIG. 7 shows schematically a hydraulic shovel equipped with a backward operating scoop, in which is incorporated the supply device of the present invention.
Figure 8:
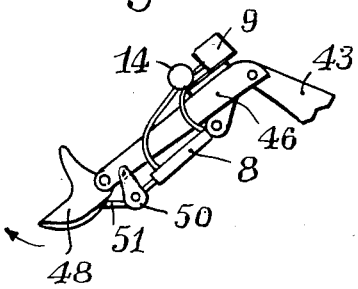
FIG. 8 is a partial view of the hydraulic shovel of FIG. 7, equipped with a loading scoop.

By way of example, in FIG. 7 is shown a hydraulic shovel 42 comprising a boom 43 which is mounted for pivoting at its rear end on the chassis of shovel 42 and which may be actuated by a piston and cylinder actuator 45, a beam 46 which is mounted for pivoting at its rear end on the front end of boom 43 and which may be actuated by a piston and cylinder actuator 47, and a bucket 48, having ripping teeth 49, which is mounted for backward pivoting at the front end of beam 46 and which may be actuated by a device such as the piston and cylinder device 8 of FIG. 1, through a rocking lever 50 and a link 51. The piston and cylinder device 8 is carried by boom 46 on which are also disposed the hydraulic block 9 and accumulator 14 of FIG. 1. FIG. 8 shows the front part of the hydraulic shovel 42 of FIG. 7, with a boom 46 equipped with a bucket 48 mounted for loading.

It goes without saying that the embodiment of the present invention which has been described above has been given by way of example, and that numerous modifications may be readily made by a man skilled in the art without departing from the scope and spirit of the invention. Thus, more particularly, the check-valve 13 (FIG. 1) may be replaced by a controlled valve identical to valve 11 and which, in a rest position, allows hydraulic fluid to flow through pipe 12 towards accumulator 14 or 29 and, in a working position, cuts off said flow. In this case, the sequential control unit 17, must actuate the controlled valve 13 at the same time as controlled valve 10. Furthermore, when the controlled valves 10, 11, 15 and possibly 13 are in the form of electro-valves, the sequential control units 17 may be made of switching transistors or integrated electronic circuits. Furthermore, instead of using electro-valves, valves may be used controlled by compressed air or by a hydraulic fluid. In this latter case, the sequential control unit 17 may itself be formed by switches and delay circuits operating with compressed air or with a pressurized hydraulic fluid. Furthermore, in the foregoing, it has been assumed that the piston and cylinder device 8 operates mainly for pushing. If it works mainly for pulling, it is sufficient to connect pipe 5 to chamber 6 and pipe 4 to chamber 7. If the piston and cylinder device 8 works both for pushing and for pulling and if hydraulic pulses must be sent both into chamber 6 and into chamber 7, it is then sufficient to insert in pipe 5 a second hydraulic block identical to the hydraulic block 9 of FIG. 1 or, more simply, to dispose a change over valve in pipes 4 and 5 between the hydraulic block 9 and the piston and cylinder device 8.

What is claimed is:

1. A method of supplying a normally continuous operating actuator with hydraulic fluid, continuously and by controlled pulses, comprising the steps of supplying a pressure chamber of the hydraulic actuator with hydraulic fluid and, simultaneously, storing hydraulic energy in an accumulator from a pressurized fluid source as long as the pressure in the pressure chamber of the actuator remains less than the chosen value, so that the actuator works normally in continuous operation, isolating the pressure chamber of the actuator from the pressurized fluid source when the pressure in the pressure chamber of the actuator reaches said chosen value, connecting the pressure chamber of the actuator to a hydraulic fluid reservoir for causing the pressure in said pressure chamber to drop, then isolating the pressure chamber of the actuator from the reservoir, then causing the accumulator to communicate only with the pressure chamber of the actuator so as to feed therein a hydraulic fluid pulse and then isolating the pressure chamber of the actuator from the accumulator and re-establishing the communication between the pressurized fluid source, on the one hand, and the pressure chamber and the accumulator, on the other hand, and maintaining them in this state as long as the pressure in the pressure chamber does not again reach said chosen value.

2. A device for supplying a normally continuous operating hydraulic actuator with hydraulic fluid, continuously and by controlled pulses, comprising a pump, a fluid reservoir, a first pipe having a first end and a second end connectible to a pressure chamber of a hydraulic actuator, a main distributor valve connected to said pump, to the reservoir and to the first end of said first pipe for causing said first pipe to communicate selectively with said pump or with said reservoir, a first controlled valve which is connected to said first pipe and to said reservoir and which has a rest position, in which said first pipe is isolated from the reservoir, and a working position, in which a communication is established between said first pipe and said reservoir, a second controlled valve which is inserted in said first pipe between the second end thereof and the first controlled valve and which has a rest position, in which fluid is allowed to flow in said first pipe, and a working position, in which said fluid flow is cut off, a second pipe having a first end and a second end which are connected to said first pipe respectively between the main distributor and said second controlled valve and between said second controlled valve and the second end of said first pipe, a first pressure accumulator connected to said second pipe, valve means inserted in said second pipe and including a third controlled valve having a rest position, in which fluid flow in said second pipe from said first accumulator to the second end of said second pipe is cut off, and a working position, in which fluid is allowed to flow from said first accumulator to the second end of the second and first pipes, control means including pressure sensitive means hydraulically connected to said first pipe for giving an indication of the value of the hydraulic pressure prevailing in said first pipe, said control means being connected to the first, second and third controlled valves and being operable, upon an indication by said pressure sensitive means, that the hydraulic pressure in said first pipe has reached a chosen value, for successively actuating, in order, the first, the second and the third controlled valves into their working position and for bringing them back to their rest position.

3. The device as claimed in claim 2, wherein an adjustable nozzle is disposed in said second pipe between the third controlled valve and the second end of said second pipe.

4. The device as claimed in claim 2, further comprising at least one other pressure accumulator having a diaphragm prestressed to a pressure different from that of the diaphragm of the first accumulator, and cocks associated with said accumulators for connecting them selectively to said second pipe.

5. The device as claimed in claim 2, wherein four check-valves, mounted as in a full-wave rectifier bridge, are inserted in the first pipe, said first pipe being connected to the ends of one diagonal of the bridge, the second controlled valve being mounted in the other diagonal of the bridge.

6. The device as claimed in claim 2, wherein said first, second and third controlled valves are electro-valves, and control means further comprises a normally open contact and a sequential control unit which comprises a first relay having a normally open contact, a second and a third relay both having a contact normally open and time delayed on closing, the duration of the time delay of the third relay being greater than that of the second relay, and a fourth relay having a normally closed contact time delayed on opening, a first terminal of energizing coils of the first, second, third and fourth relays and of the first, second and third electro-valves being connected to a first terminal of a power supply source, a second terminal of the energizing coils of the first, second and third relays and of the first and second electro-valves, the coil of the second electro-valve through the normally open contact of said second relay, being connected to a second terminal of the power supply source, on the one hand, through the normally open contact of the control means and, on the other and, through the normally open contact of the first relay and the normally closed contact of the fourth relay connected in series, second terminal of the energizing coils of the fourth relay and of the third electro-valve being connected to a junction point between the normally open contact of the first relay and the normally closed contact of the fourth relay through the normally open contact of the third relay.

7. The device as claimed in claim 6, wherein said pressure sensitive means is a pressure controlled switch, and the normally open contact of the control means is a contact of said pressure controlled switch.

8. The device as claimed in claim 6, wherein the normally open contact of the control means is a push button contact, and said pressure sensitive means is a pressure gauge.

9. The device as claimed in claim 6, wherein said pressure sensitive means is a pressure controlled switch, and said control means comprises two normally open contacts, connected in parallel, one of them being a push button contact, the other a contact of said pressure controlled switch.

10. A civil work or agricultural machine comprising a working equipment actuated by a normally continuous operating hydraulic actuator, further comprising a supply device such as claimed in claim 2 for supplying the hydraulic actuator with an hydraulic fluid.

11. The device as claimed in claim 2, wherein said valve means further comprises a check-valve inserted in the second pipe between the first end of said second pipe and said first accumulator, said check-valve being connected so as to allow fluid flow in said second pipe only from the first end thereof to said first accumulator.

* * * * *